US011776484B2

(12) United States Patent
Lim et al.

(10) Patent No.: US 11,776,484 B2
(45) Date of Patent: Oct. 3, 2023

(54) DISPLAY DEVICE

(71) Applicant: SAMSUNG DISPLAY CO., LTD., Yongin-si (KR)

(72) Inventors: Hyun Ho Lim, Yongin-si (KR); Hyun Ha Yang, Yongin-si (KR); Myeong Bin Lim, Yongin-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/556,064

(22) Filed: Dec. 20, 2021

(65) Prior Publication Data

US 2022/0328012 A1 Oct. 13, 2022

(30) Foreign Application Priority Data

Apr. 13, 2021 (KR) ..... 10-2021-0048083

(51) Int. Cl.
*G09G 3/3291* (2016.01)

(52) U.S. Cl.
CPC ... *G09G 3/3291* (2013.01); *G09G 2310/0272* (2013.01); *G09G 2310/0291* (2013.01); *G09G 2310/08* (2013.01); *G09G 2320/0285* (2013.01); *G09G 2320/0673* (2013.01); *G09G 2330/021* (2013.01)

(58) Field of Classification Search
CPC ..... G09G 3/2092; G09G 2310/08; G09G 2310/027; G09G 2320/0673; G09G 2300/0439; G09G 2320/0276
See application file for complete search history.

(56) References Cited

U.S. PATENT DOCUMENTS 6,995,758 B2 * 2/2006 Fukuda ..... G09G 3/3696 345/98
7,046,224 B2 * 5/2006 Monomohshi ..... G09G 3/3688 345/89
7,158,108 B2 * 1/2007 Hagino ..... G09G 3/3696 345/98
7,595,776 B2 * 9/2009 Hashimoto ..... G09G 3/3233 345/76
8,519,926 B2 8/2013 Lim
8,525,765 B2 * 9/2013 Kim ..... G09G 3/3696 345/89

(Continued)

FOREIGN PATENT DOCUMENTS

KR 100604866 B1 7/2006
KR 101250787 B1 4/2013
KR 1020200108226 A 9/2020

*Primary Examiner* — Michael J Jansen, II
(74) *Attorney, Agent, or Firm* — CANTOR COLBURN LLP

(57) ABSTRACT

A display device of the invention includes a pixel unit including first pixels which display a first color; and a data driver which supplies first data voltages to the first pixels. The data driver includes: a first master gamma block including first master amplifiers which generate first reference gamma voltages; a first slave gamma block which generates first gamma voltages by dividing the first reference gamma voltages; and a first decoder which provides some of the first gamma voltages as the first data voltages, and each of the first master amplifiers is enabled or disabled based on a maximum luminance of the pixel unit.

20 Claims, 12 Drawing Sheets

(56) References Cited

U.S. PATENT DOCUMENTS

| | | | | |
|---|---|---|---|---|
| 8,823,753 | B2 * | 9/2014 | Kim | G09G 3/3696 345/84 |
| 10,559,280 | B2 * | 2/2020 | Bae | G09G 3/2092 |
| 11,276,370 | B2 * | 3/2022 | Kim | G09G 5/10 |
| 2002/0044142 | A1 * | 4/2002 | Fukuda | G09G 3/3696 345/204 |
| 2003/0201962 | A1 * | 10/2003 | Monomohshi | G09G 3/3696 345/89 |
| 2005/0078077 | A1 * | 4/2005 | Hagino | G09G 3/2011 345/100 |
| 2005/0168416 | A1 * | 8/2005 | Hashimoto | G09G 3/3291 345/76 |
| 2005/0270263 | A1 * | 12/2005 | Kim | G09G 3/3688 345/98 |
| 2008/0001897 | A1 * | 1/2008 | Lim | G09G 3/3688 345/98 |
| 2010/0225678 | A1 * | 9/2010 | Kim | G09G 3/3696 345/84 |
| 2011/0032279 | A1 * | 2/2011 | Kim | G09G 3/2007 345/89 |
| 2017/0046993 | A1 * | 2/2017 | Chang | G09G 3/2003 |
| 2018/0268780 | A1 * | 9/2018 | Bae | G09G 5/026 |
| 2020/0286448 | A1 | 9/2020 | Kim et al. | |
| 2022/0328012 | A1 * | 10/2022 | Lim | G09G 3/3291 |

* cited by examiner

FIG. 7

11MEM

| DBV | LUT |
|---|---|
| DBV8 < DBV < FFFh | LUT10 |
| DBV7 < DBV < DBV8 | LUT9 |
| DBV6 < DBV < DBV7 | LUT8 |
| DBV5 < DBV < DBV6 | LUT7 |
| DBV4 < DBV < DBV5 | LUT6 |
| DBV3 < DBV < DBV4 | LUT5 |
| DBV2 < DBV < DBV3 | LUT4 |
| DBV1 < DBV < DBV2 | LUT3 |
| 000h < DBV < DBV1 | LUT2 |
| 000h | LUT1 |

FIG. 8

LUT10

| Gamma Tab | EN/DIS |
|---|---|
| MG1, SG1 | EN/DIS1(Enable) |
| MG2, SG2 | EN/DIS2(Enable) |
| MG3, SG3 | EN/DIS3(Enable) |
| MG4, SG4 | EN/DIS4(Enable) |
| MG5, SG5 | EN/DIS5(Enable) |
| MG6, SG6 | EN/DIS6(Enable) |
| MG7, SG7 | EN/DIS7(Enable) |
| MG8, SG8 | EN/DIS8(Enable) |
| MG9, SG9 | EN/DIS9(Enable) |
| MG10, SG10 | EN/DIS10(Enable) |

FIG. 9

LUT5

| Gamma Tab | EN/DIS |
|---|---|
| MG1, SG1 | EN/DIS1(Enable) |
| MG2, SG2 | EN/DIS2(Disable) |
| MG3, SG3 | EN/DIS3(Enable) |
| MG4, SG4 | EN/DIS4(Disable) |
| MG5, SG5 | EN/DIS5(Enable) |
| MG6, SG6 | EN/DIS6(Disable) |
| MG7, SG7 | EN/DIS7(Enable) |
| MG8, SG8 | EN/DIS8(Disable) |
| MG9, SG9 | EN/DIS9(Enable) |
| MG10, SG10 | EN/DIS10(Enable) |

FIG. 10

LUT2

| Gamma Tab | EN/DIS |
|---|---|
| MG1, SG1 | EN/DIS1(Enable) |
| MG2, SG2 | EN/DIS2(Disable) |
| MG3, SG3 | EN/DIS3(Disable) |
| MG4, SG4 | EN/DIS4(Disable) |
| MG5, SG5 | EN/DIS5(Enable) |
| MG6, SG6 | EN/DIS6(Disable) |
| MG7, SG7 | EN/DIS7(Disable) |
| MG8, SG8 | EN/DIS8(Enable) |
| MG9, SG9 | EN/DIS9(Disable) |
| MG10, SG10 | EN/DIS10(Enable) |

FIG. 12

12MEM

| GMCD2 | LUT |
|---|---|
| GMCD2_8 < GMCD2 < GMCD2_9 | LUT10 |
| GMCD2_7 < GMCD2 < GMCD2_8 | LUT9 |
| GMCD2_6 < GMCD2 < GMCD2_7 | LUT8 |
| GMCD2_5 < GMCD2 < GMCD2_6 | LUT7 |
| GMCD2_4 < GMCD2 < GMCD2_5 | LUT6 |
| GMCD2_3 < GMCD2 < GMCD2_4 | LUT5 |
| GMCD2_2 < GMCD2 < GMCD2_3 | LUT4 |
| GMCD2_1 < GMCD2 < GMCD2_2 | LUT3 |
| 000h < GMCD2 < GMCD2_1 | LUT2 |
| 000h | LUT1 |

DISPLAY DEVICE

The application claims priority to Korean Patent Application No. 10-2021-0048083, filed Apr. 13, 2021, and all the benefits accruing therefrom under 35 U.S.C. § 119, the content of which in its entirety is herein incorporated by reference.

BACKGROUND

1. Field

The invention relates to a display device.

2. Discussion of the Related Art

With the development of information technology, the importance of display devices, which are a connection medium between users and information, has been emphasized. Accordingly, display devices such as a liquid crystal display device, an organic light emitting display device, and the like are widely used in various fields.

A display device typically includes a plurality of pixels, and the pixels may display an image by emitting light based on the received data voltages. A data driver of the display device may generate gamma voltages corresponding to a luminance scheme in advance, and may provide gamma voltages corresponding to a grayscale as the data voltages.

SUMMARY

Embodiments of the invention are to provide a display device capable of reducing power consumption when generating gamma voltages.

An embodiment of a display device according to the invention includes a pixel unit including first pixels which display a first color; and a data driver supplying first data voltages to the first pixels. In such an embodiment, the data driver includes: a first master gamma block including first master amplifiers which generate first reference gamma voltages; a first slave gamma block which generates first gamma voltages by dividing the first reference gamma voltages; and a first decoder which provides some of the first gamma voltages as the first data voltages, and each of the first master amplifiers is enabled or disabled based on a maximum luminance of the pixel unit.

In an embodiment, when the maximum luminance is set to a first maximum luminance, u first master amplifiers among the first master amplifiers may be enabled and the rest may be disabled, where u is an integer greater than 0. In such an embodiment, when the maximum luminance is set to a second maximum luminance different from the first maximum luminance, v first master amplifiers among the first master amplifiers may be enabled and the rest first master amplifiers may be disabled, where v is an integer greater than u.

In an embodiment, the second maximum luminance may be greater than the first maximum luminance.

In an embodiment, the first master gamma block may further include a first multiplexer which provides an input voltage of at least one selected from the first master amplifiers based on a first gamma code applied to.

In an embodiment, the first master gamma block may further include a second multiplexer which provides an input voltage of at least another one selected from the first master amplifiers based on a second gamma code applied thereto.

In an embodiment, the first gamma code at the first maximum luminance and the first gamma code at the second maximum luminance may be the same as each other, and the second gamma code at the first maximum luminance and the second gamma code at the second maximum luminance may be different from each other.

In an embodiment, the input voltage provided by the second multiplexer at the first maximum luminance may be greater than the input voltage provided by the second multiplexer at the second maximum luminance.

In an embodiment, the display device may further include a memory which stores look-up tables, and enable or disable states of the first master amplifiers corresponding to a level of the maximum luminance may be recorded in the look-up tables.

In an embodiment, the first slave gamma block may include first slave amplifiers connected to the first master amplifiers, respectively, and when one of the first master amplifiers is enabled or disabled, a corresponding one of the first slave amplifiers connected may be enabled or disabled together.

In an embodiment, the display device may further include a memory which stores look-up tables, and enable or disable states of the first master amplifiers and the first slave amplifiers corresponding to a level of the maximum luminance may be recorded in the look-up tables.

In an embodiment, the display device may further include a timing controller including the memory, where the timing controller may provide enable/disable information corresponding to the level of the maximum luminance received with reference to the look-up tables to the data driver, and the first master amplifiers and the first slave amplifiers may be enabled or disabled according to the enable/disable information.

In an embodiment, the display device may further include a memory which stores look-up tables, and enable or disable states of the first master amplifiers and the first slave amplifiers corresponding to a level of a gamma code may be recorded in the look-up tables.

In an embodiment, the display device may further include a timing controller which provides the gamma code corresponding to a level of the maximum luminance received thereby to the data driver, and the data driver may include the memory, and the first master amplifiers and the first slave amplifiers may be enabled or disabled with reference to the level of the gamma code and the look-up tables.

In an embodiment, the pixel unit further include second pixels which display a second color different from the first color; and third pixels which display a third color different from the first color and the second color. In such an embodiment, the data driver may supply second data voltages to the second pixels and supply third data voltages to the third pixels, and the data driver may include a first sub-driver, a second sub-driver, and a third sub-driver. In such an embodiment, the first sub-driver may include the first master gamma block, the first slave gamma block, a second slave gamma block, a third slave gamma block, and the first decoder. In such an embodiment, the second slave gamma block may divide second reference gamma voltages to generate second gamma voltages, the third slave gamma block may divide third reference gamma voltages to generate third gamma voltages, and the first decoder may provide some of the second gamma voltages as the second data voltages, and provide some of the third gamma voltages as the third data voltages.

In an embodiment, the second sub-driver may include a second master gamma block, a fourth slave gamma block, a fifth slave gamma block, a sixth slave gamma block, and a second decoder. In such an embodiment, the second master gamma block may generate the second reference gamma voltages. In such an embodiment, the fourth slave gamma block may divide the first reference gamma voltages to generate the first gamma voltages, the fifth slave gamma block may divide the second reference gamma voltages to generate the second gamma voltages, the sixth slave gamma block may divide the third reference gamma voltages to generate the third gamma voltages. In such an embodiment, the second decoder may provide some of the first gamma voltages as the first data voltages, provide some of the second gamma voltages as the second data voltages, and provide some of the third gamma voltages as the third data voltages.

In an embodiment, the third sub-driver may include a third master gamma block, a seventh slave gamma block, an eighth slave gamma block, a ninth slave gamma block, and a third decoder. In such an embodiment, the third master gamma block may generate the third reference gamma voltages. In such an embodiment, the seventh slave gamma block may divide the first reference gamma voltages to generate the first gamma voltages, the eighth slave gamma block may divide the second reference gamma voltages to generate the second gamma voltages, and the ninth slave gamma block may divide the third reference gamma voltages to generate the third gamma voltages. In such an embodiment, the third decoder may provide some of the first gamma voltages as the first data voltages, provide some of the second gamma voltages as the second data voltages, and provide some of the third gamma voltages as the third data voltages.

In an embodiment, the first sub-driver may further include a first output buffer which provides an output of the first decoder to the pixel unit. In such an embodiment, the second sub-driver may further include a second output buffer which provides an output of the second decoder to the pixel unit, and the third sub-driver may further include a third output buffer which provides an output of the third decoder to the pixel unit.

In an embodiment, data lines connected to the first output buffer, data lines connected to the second output buffer, and data lines connected to the third output buffer may be different from each other.

In an embodiment, pixels connected to the first output buffer, pixels connected to the second output buffer, and pixels connected to the third output buffer may be different from each other.

In an embodiment, a first power input terminal of each of the first master amplifiers be connected to a switch, and each of the first master amplifiers may be disabled when the switch is turned off, and may be enabled when the switch is turned on.

BRIEF DESCRIPTION OF THE DRAWINGS

The above and other features of the invention will become more apparent by describing in further detail embodiments thereof with reference to the accompanying drawings, in which:

FIGS. 7 to 10 are diagrams showing a look-up table according to an embodiment of the invention;

FIG. 12 is a diagram showing a look-up table according to an alternative embodiment of the invention.

DETAILED DESCRIPTION

Figure 1:
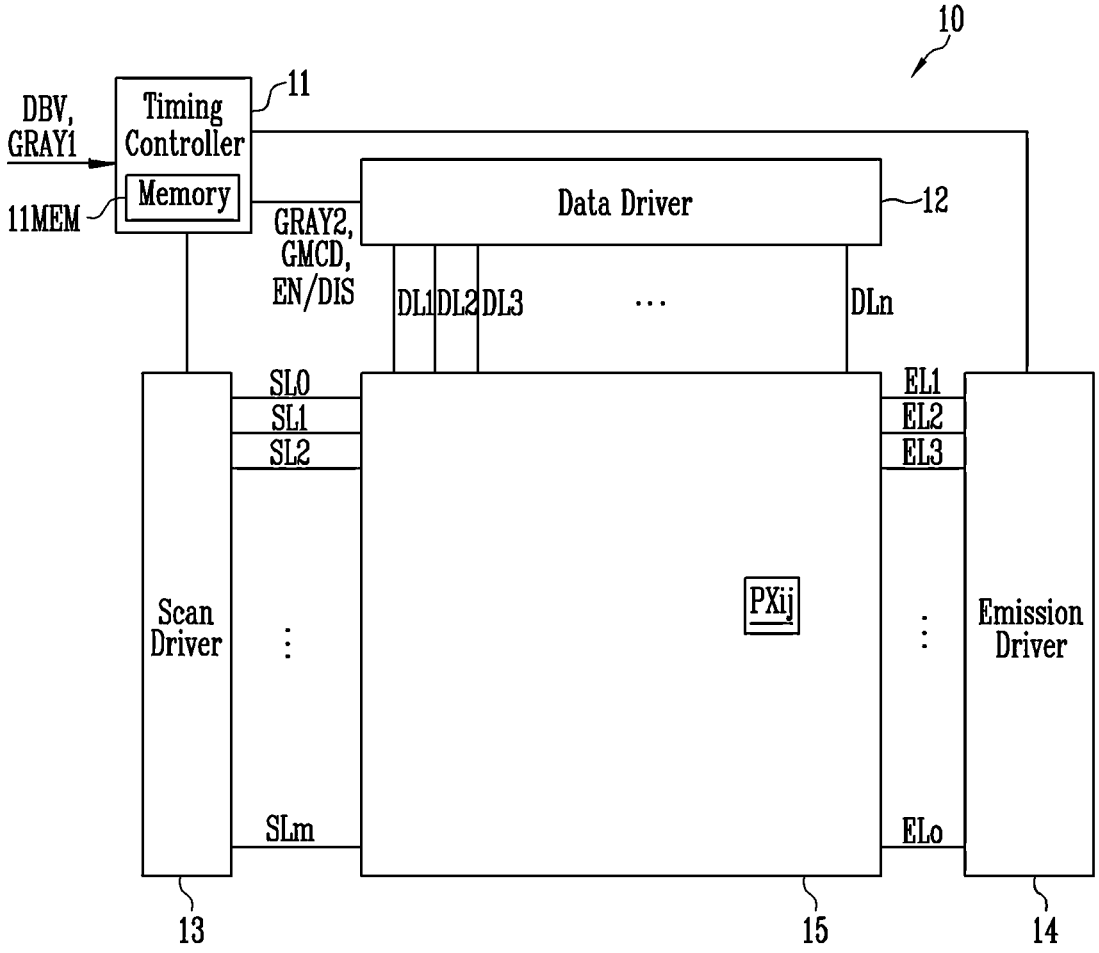
FIG. 1 is a diagram showing a display device according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In addition, the size and thickness of each component shown in the drawings are arbitrarily shown for convenience of description. In the drawings, thicknesses may be exaggerated to clearly express the layers and regions. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims In addition, in the description, the expression "is the same" may mean "substantially the same". That is, the expression "is the same" may be the same enough to convince those of ordinary skill in the art to be the same. In other expressions, "substantially" may be omitted.

Hereinafter, embodiments of the invention will be described in detail with reference to the accompanying drawings.

FIG. 1 is a diagram showing a display device according to an embodiment of the invention.

Referring to FIG. 1, an embodiment of a display device 10 according to the invention may include a timing controller 11, a data driver 12, a scan driver 13, an emission driver 14, and a pixel unit 15.

The timing controller 11 may receive grayscales GRAY1 and control signals DBV for each input image (frame) from an external device, e.g., a processor.

A maximum luminance DBV may be luminance information of light emitted from pixels set to a maximum grayscale. In one embodiment, for example, the maximum luminance DBV may be the luminance of white light generated when all pixels of the pixel unit 15 emit light to correspond to the white grayscale. The unit of luminance may be Nits or candela per square meter (cd/m$^2$). The maximum luminance DBV may be referred to as a display brightness value. The maximum luminance DBV may be manually set by a user's manipulation of the display device 10 or may be automatically set by an algorithm linked to an illuminance sensor or the like. In one embodiment, for example, a maximum value of the maximum luminance DBV may be about 1200 nits, and a minimum value may be about 4 nits. The maximum and minimum values of the maximum luminance DBV may be variously set on a product-by-product basis. Even in cases where the grayscales are the same as each other, since a data voltage varies according to the maximum luminance DBV, the luminance of light emitted by the pixel may also vary or be different from each other.

In an embodiment, the timing controller 11 may provide grayscales GRAY2 generated by compensating the grayscales GRAY1 to the data driver 12. In one embodiment, for example, driving transistors and light emitting elements of the pixels may have a process deviation and a deterioration deviation. In an embodiment, the timing controller 11 may generate the grayscales GRAY2 by compensating the grayscales GRAY1 to compensate for at least one of such deviations. In an embodiment, the timing controller 11 may generate the grayscales GRAY2 by spatially/temporally rendering the grayscales GRAY1. In an embodiment, the timing controller 11 may provide the grayscales GRAY2 identical to the grayscales GRAY1 to the data driver 12.

The timing controller 11 may provide control signals suitable for each specification to the data driver 12, the scan driver 13, and the emission driver 14 to display an input image.

In an embodiment, the timing controller 11 may provide a gamma code GMCD to the data driver 12. In one embodiment, for example, the timing controller 11 may provide the gamma code GMCD corresponding to the received maximum luminance DBV to the data driver 12. When the received maximum luminance DBV is high, a range of gamma voltages (a difference between a maximum gamma voltage and a minimum gamma voltage) is set to be wide. Also, when the received maximum luminance DBV is low, the range of gamma voltages are set to be narrow. The gamma code GMCD may be a set value for the range of such gamma voltages.

In an embodiment, the timing controller 11 may provide enable/disable information EN/DIS to the data driver 12. In one embodiment, for example, the timing controller 11 may include a memory 11MEM, and the memory 11MEM may store look-up tables. In an embodiment, enable or disable states of master amplifiers corresponding to a level of the maximum luminance DBV may be recorded in the look-up tables. In such an embodiment, the enable/disable information EN/DIS may be an instruction for the enable or disable states of the master amplifiers corresponding to the level of the received maximum luminance DBV. In an alternative embodiment, enable or disable states of the master amplifiers and slave amplifiers corresponding to the level of the maximum luminance DBV may be recorded in the look-up tables. In such an embodiment, the enable/disable information EN/DIS may be an indication of the enable or disable states of the master amplifiers and the slave amplifiers corresponding to the level of the received maximum luminance DBV.

The pixel unit 15 may include a plurality of pixels. The pixels may display an output image. Each pixel PXij may be connected to a corresponding data line, a corresponding scan line, and a corresponding emission line.

The pixel unit 15 may include first pixels, second pixels, and third pixels. The first pixels may display a first color, the second pixels may display a second color, and the third pixels may display a third color. In one embodiment, for example, the first pixels may include light emitting element of the first color, the second pixels may include light emitting elements of the second color, and the third pixels may include light emitting elements of the third color. The first color, the second color and the third color may be different from each other. In one embodiment, for example, the first color may be one of red, green, and blue. The second color may be one color other than the first color among red, green, and blue. The third color may be one color other than the first color and the second color among red, green, and blue. In an alternative embodiment, the first to third colors may be magenta, cyan, and yellow.

The data driver 12 may generate data voltages to be provided to data lines DL1, DL2, DL3, . . . , and DLn using the grayscales GRAY2 and control signals GMCD, EN/DIS. In one embodiment, for example, the data driver 12 may sample the grayscales using a clock signal, and may apply the data voltages corresponding to the grayscales to the data lines DL1 to DLn in units of pixel rows (for example, pixels connected to a same scan line), where n may be an integer greater than 0.

The data driver 12 may supply first data voltages to the first pixels, may supply second data voltages to the second pixels, and may supply third data voltages to the third pixels.

The scan driver 13 may receive a clock signal, a scan start signal, and the like from the timing controller 11 and generate scan signals to be provided to scan lines SL0, SL1, SL2, . . . , and SLm, where m may be an integer greater than 0.

The scan driver 13 may sequentially supply the scan signals of a turn-on level to the scan lines SL0 to SLm. The scan driver 13 may include scan stages configured in a form of a shift register. The scan driver 13 may generate the scan signals by sequentially transferring the scan start signal of a turn-on level to a subsequent scan stage under control of the clock signal.

The emission driver 14 may receive a clock signal, an emission stop signal, and the like from the timing controller 11 to generate emission signals to be provided to emission lines EL1, EL2, EL3, . . . , and ELo, where o may be an integer greater than 0. In one embodiment, for example, the emission driver 14 may sequentially provide the emission signals of a turn-off level to the emission lines EL1 to ELo. In one embodiment, for example, emission stages of the emission driver 14 may be configured in a form of a shift register, and may generate the emission signals by sequentially transferring the emission stop signal of a turn-off level to a subsequent emission stage under control of the clock signal. In an alternative embodiment, the emission driver 14 may be omitted depending on a circuit configuration of the pixel PXij.

Figure 2:
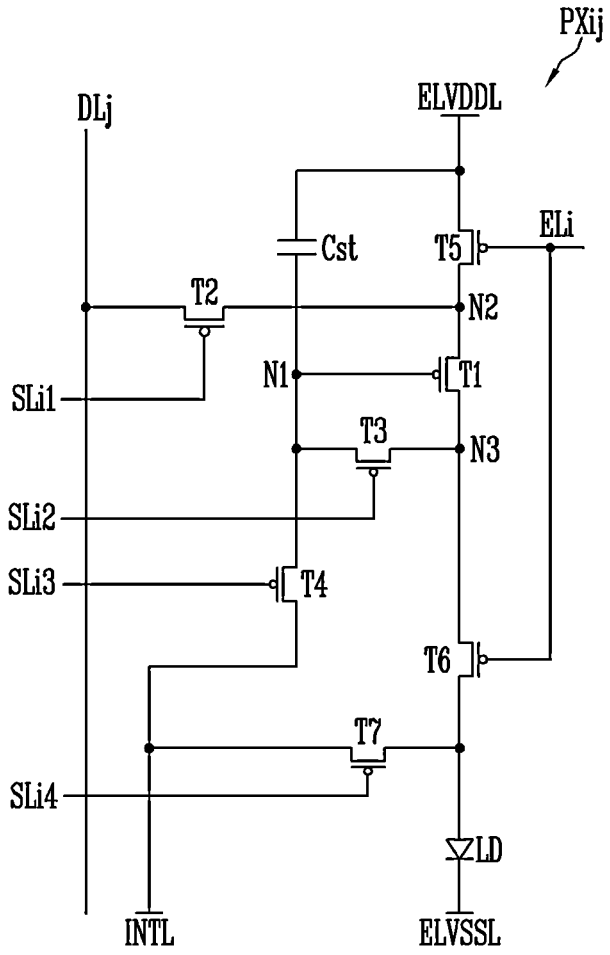
FIG. 2 is a diagram showing a pixel according to an embodiment of the invention.

FIG. 2 is a diagram showing a pixel according to an embodiment of the invention.

Referring to FIG. 2, an embodiment of the pixel PXij may include transistors T1, T2, T3, T4, T5, T6, and T7, a storage capacitor Cst, and a light emitting element LD.

Hereinafter, for convenience of description, embodiments where the pixel PXij has a circuit structure composed of P-type transistors will be described in detail. However, those skilled in the art may design a circuit composed of N-type transistors by changing the polarity of a voltage applied to a gate terminal. Similarly, those skilled in the art will be able to design a circuit composed of a combination of a P-type transistor and an N-type transistor. The P-type transistor may generally refer to a transistor in which the amount of current increases when a voltage difference between a gate electrode and a source electrode increases in a negative direction. The N-type transistor may generally refer to a transistor in which the amount of current increases when the voltage difference between the gate electrode and the source electrode increases in a positive direction. Each of the transistors may be one of various types of transistors such as a thin film transistor ("TFT"), a field effect transistor ("FET"), and a bipolar junction transistor ("BJT").

A first transistor T1 may include a gate electrode connected to a first node N1, a first electrode connected to a second node N2, and a second electrode connected to a third node N3. The transistor T1 may be referred to as a driving transistor.

A second transistor T2 may include a gate electrode connected to a first scan line SLi1, a first electrode connected to a data line DLj, and a second electrode connected to the second node N2. The second transistor T2 may be referred to as a scan transistor.

A third transistor T3 may include a gate electrode connected to a second scan line SLi2, a first electrode connected to the first node N1, and a second electrode connected to the third node N3. The third transistor T3 may be referred to as a diode-connected transistor.

A fourth transistor T4 may include a gate electrode connected to a third scan line SLi3, a first electrode connected to the first node N1, and a second electrode connected to an initialization line INTL. The fourth transistor T4 may be referred to as a gate initialization transistor.

A fifth transistor T5 may include a gate electrode connected to an i-th emission line ELi, a first electrode connected to a first power line ELVDDL, and a second electrode connected to the second node N2. The fifth transistor T5 may be referred to as an emission transistor. In an alternative embodiment, the gate electrode of the fifth transistor T5 may be connected to another emission line.

A sixth transistor T6 may include a gate electrode connected to the i-th emission line ELi, a first electrode connected to the third node N3, and a second electrode connected to an anode of the light emitting element LD. The sixth transistor T6 may be referred to as an emission transistor. In an alternative embodiment, the gate electrode of the sixth transistor T6 may be connected to an emission line different from the emission line to which the gate electrode of the fifth transistor T5 is connected.

A seventh transistor T7 may include a gate electrode connected to a fourth scan line SLi4, a first electrode connected to the initialization line INTL, and a second electrode connected to the anode of the light emitting element LD. The seventh transistor T7 may be referred to as a light emitting element initialization transistor.

The storage capacitor Cst may include a first electrode connected to the first power line ELVDDL and a second electrode connected to the first node N1.

The light emitting element LD may include the anode connected to the second electrode of the sixth transistor T6 and a cathode connected to a second power line ELVSSL. In an embodiment, the light emitting element LD may be a light emitting diode. In such an embodiment, the light emitting element LD may be an organic light emitting diode, an inorganic light emitting diode, a quantum dot/well light emitting diode, or the like. The light emitting element LD may emit light in any one of the first color, the second color, and the third color. In an embodiment, a single light emitting element LD is included in each pixel. However, in an alternative embodiment, a plurality of light emitting elements may be provided in each pixel. In such an embodiment, the plurality of light emitting elements may be connected in series, in parallel, or in series and parallel.

A first power voltage may be applied to the first power line ELVDDL, a second power voltage may be applied to the second power line ELVSSL, and an initialization voltage may be applied to the initialization line INTL. In one embodiment, for example, the first power voltage may be greater than the second power voltage. In one embodiment, for example, the initialization voltage may be equal to or greater than the second power voltage. In one embodiment, for example, the initialization voltage may correspond to a data voltage having the smallest size among the data voltages to be provided. In an alternative embodiment, the size of the initialization voltage may be smaller than the sizes of the data voltages that can be provided.

Figure 3:
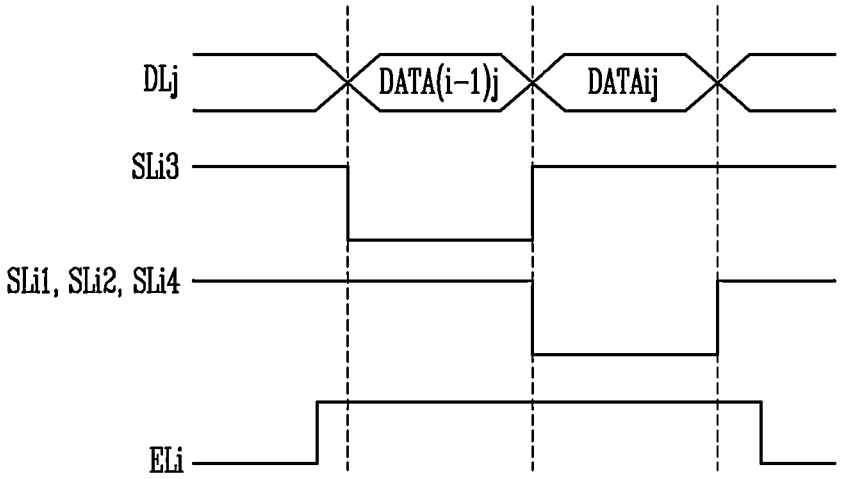
FIG. 3 is a diagram showing an embodiment of a driving method of the pixel of FIG. 2.

FIG. 3 is a diagram showing an embodiment of a driving method of the pixel of FIG. 2.

Hereinafter, for convenience of description, embodiments where the first scan line SLi1, the second scan line SLi2, and the fourth scan line SLi4 are an i-th scan line, and the third scan line SLi3 is an (i−1)-th scan line, respectively, will be described in detail. However, the first to fourth scan lines SLi1, SLi2, SLi3, and SLi4 may have various different connection relationships according to alternative embodiments. In one alternative embodiment, for example, the fourth scan line SLi4 may be the (i−1)-th scan line or an (i+1)-th scan line.

In an embodiment, as shown in FIG. 3, a data voltage DATA(i−1)j for an (i−1)-th pixel in a j-th pixel column may be applied to the data line DLj, and a scan signal of a turn-on level (logic low level) may be applied to the third scan line SLi3.

In this case, since a scan signal of a turn-off level (logic high level) is applied to the first and second scan lines SLi1 and SLi2, the second transistor T2 may be in a turned-off state, and the data voltage DATA(i−1)j for the (i−1)-th pixel in the j-th pixel column may be effectively prevented from being written into the pixel PXij.

In this case, since the fourth transistor T4 is in a turned-on state, the first node N1 may be connected to the initialization line INTL such that a voltage of the first node N1 may be initialized. Since the emission signal of the turn-off level is applied to the emission line ELi, the transistors T5 and T6 may be in the turned-off state, and undesired light emission from the light emitting element LD due to a process of applying the initialization voltage may be effectively prevented.

In such an embodiment, as shown in FIG. 3, the data voltage DATAij for the i-th pixel PXij may be applied to the data line DLj, and the scan signal of the turn-on level may be applied to the first and second scan lines SLi1 and SLi2. Accordingly, the transistors T2, T1, and T3 may be turned on, and the data line DLj and the first node N1 may be electrically connected to each other. Accordingly, a compensation voltage obtained by subtracting a threshold voltage of the first transistor T1 from the data voltage DATAij may be applied to the second electrode of the storage capacitor Cst (that is, the first node N1), and the storage capacitor Cst may maintain a voltage corresponding to a difference between the first power voltage and the compensation voltage. This period may be referred to as a threshold voltage compensation period.

In such an embodiment, where the fourth scan line SLi4 is the i-th scan line, since the seventh transistor T7 is in the turned-on state, the anode of the light emitting element LD and the initialization line INTL may be connected to each other, and the light emitting element LD may be initialized with the amount of charge corresponding to a voltage difference between the initialization voltage and the second power voltage.

Thereafter, as an emission signal of a turn-on level is applied to the emission line ELi, the transistors T5 and T6 may be turned on. Accordingly, a driving current path may be formed through the first power line ELVDDL, the fifth transistor T5, the first transistor T1, the sixth transistor T6, the light emitting element LD, and the second power line ELVSSL.

The amount of driving current flowing through the first electrode and the second electrode of the first transistor T1 may be adjusted based on the voltage maintained in the storage capacitor Cst. The light emitting element LD may emit light with a luminance corresponding to the amount of driving current. The light emitting element LD may emit light until the emission signal of the turn-off level is applied to the emission line ELi.

Figure 4:
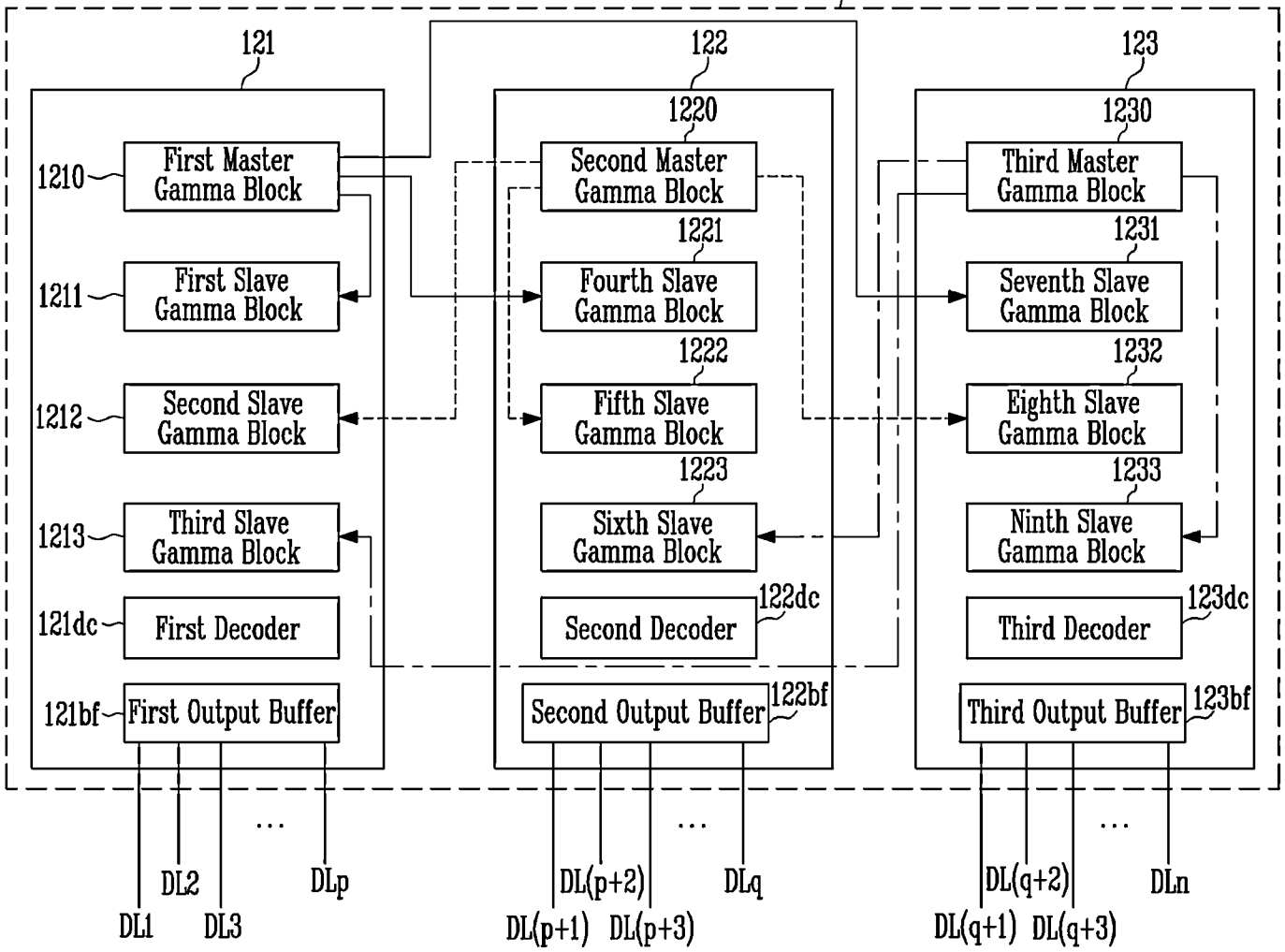
FIG. 4 is a diagram showing a data driver according an embodiment of the invention.

FIG. 4 is a diagram showing a data driver according an embodiment of the invention.

Referring to FIG. 4, an embodiment of the data driver 12 according to the invention may include a first sub-driver 121, a second sub-driver 122, and a third sub-driver 123.

The first sub-driver 121 may include a first master gamma block 1210, a first slave gamma block 1211, a second slave gamma block 1212, a third slave gamma block 1213, a first decoder 121*dc*, and a first output buffer 121*bf*.

The first master gamma block 1210 may generate first reference gamma voltages. In an embodiment, the first master gamma block 1210 may not generate second reference gamma voltages and third reference gamma voltages. Accordingly, in such an embodiment, the first sub-driver 121 may receive the second reference gamma voltages from a second master gamma block 1220 of the second sub-driver 122 and may receive the third reference gamma voltages from a third master gamma block 1230 of the third sub-driver 123. The first slave gamma block 1211 may divide the first reference gamma voltages to generate first gamma voltages. The second slave gamma block 1212 may divide the second reference gamma voltages to generate second gamma voltages. The third slave gamma block 1213 may divide the third reference gamma voltages to generate third gamma voltages.

The first reference gamma voltages, the first gamma voltages, and the first data voltages may be voltages for the first pixels. The second reference gamma voltages, the second gamma voltages, and the second data voltages may be voltages for the second pixels. The third reference gamma voltages, the third gamma voltages, and the third data voltages may be voltages for the third pixels. The second slave gamma block 1212 may receive the second reference gamma voltages from the second master gamma block 1220 of the second sub-driver 122. The third slave gamma block 1213 may receive the third reference gamma voltages from the third master gamma block 1230 of the third sub-driver 123. In such an embodiment, each of the sub-drivers 121, 122, and 123 may include a master gamma block for one color, such that configuration cost may be reduced.

The first decoder 121*dc* may provide some of the first gamma voltages provided by the first slave gamma block 1211 as the first data voltages, may provide some of the second gamma voltages provided by the second slave gamma block 1212 as the second data voltages, and may provide some of the third gamma voltages provided by the third slave gamma block 1213 as the third data voltages.

The first output buffer 121*bf* may provide an output of the first decoder 121*dc* to the pixel unit 15. In one embodiment, for example, the first output buffer 121*bf* may be connected to data lines DL1, DL2, DL3, . . . , and DLp. The data lines DL1, DL2, DL3, . . . , and DLp may be connected to a part of the first pixels, a part of the second pixels, and a part of the third pixels.

The second sub-driver 122 may include the second master gamma block 1220, a fourth slave gamma block 1221, a fifth slave gamma block 1222, a sixth slave gamma block 1223, a second decoder 122*dc*, and a second output buffer 122*bf*.

The second master gamma block 1220 may generate the second reference gamma voltages. In an embodiment, the second master gamma block 1220 may not generate the first reference gamma voltages and the third reference gamma voltages. Accordingly, in such an embodiment, the second sub-driver 122 may receive the first reference gamma voltages from the first master gamma block 1210 of the first sub-driver 121 and may receive the third reference gamma voltages from the third master gamma block 1230 of the third sub-driver 123. The fourth slave gamma block 1221 may divide the first reference gamma voltages to generate the first gamma voltages. The fifth slave gamma block 1222 may divide the second reference gamma voltages to generate the second gamma voltages. The sixth slave gamma block 1223 may divide the third reference gamma voltages to generate the third gamma voltages.

The fourth slave gamma block 1221 may receive the first reference gamma voltages from the first master gamma block 1210 of the first sub-driver 121. The sixth slave gamma block 1223 may receive the third reference gamma voltages from the third master gamma block 1230 of the third sub-driver 123. In such an embodiment, each of the sub-drivers 121, 122, and 123 may include a master gamma block for one color, such that configuration cost may be reduced.

The second decoder 122*dc* may provide some of the first gamma voltages provided by the fourth slave gamma block 1221 as the first data voltages, may provide some of the second gamma voltages provided by the fifth slave gamma block 1222 as the second data voltages, and may provide some of the third gamma voltages provided by the sixth slave gamma block 1223 as the third data voltages.

The second output buffer 122*bf* may provide an output of the second decoder 122*dc* to the pixel unit 15. In one embodiment, for example, the second output buffer 122*bf* may be connected to data lines DL(p+1), DL(p+2), DL(p+3), . . . , and DLq. The data lines DL(p+1), DL(p+2), DL(p+3), . . . , and DLq may be connected to another part of the first pixels, another part of the second pixels, and another part of the third pixels.

The third sub-driver 123 may include the third master gamma block 1230, a seventh slave gamma block 1231, an eighth slave gamma block 1232, a ninth slave gamma block 1233, a third decoder 123*dc*, and a third output buffer 123*bf*.

The third master gamma block 1230 may generate the third reference gamma voltages. In an embodiment, the third master gamma block 1230 may not generate the first reference gamma voltages and the second reference gamma voltages. Accordingly, in such an embodiment, the third sub-driver 123 may receive the first reference gamma voltages from the first master gamma block 1210 of the first sub-driver 121 and may receive the second reference gamma voltages from the second master gamma block 1220 of the second sub-driver 122. The seventh slave gamma block 1231 may divide the first reference gamma voltages to generate the first gamma voltages. The eighth slave gamma block 1232 may divide the second reference gamma voltages to generate the second gamma voltages. The ninth slave gamma block 1233 may divide the third reference gamma voltages to generate the third gamma voltages.

The seventh slave gamma block 1231 may receive the first reference gamma voltages from the first master gamma block 1210 of the first sub-driver 121. The eighth slave gamma block 1232 may receive the second reference gamma voltages from the second master gamma block 1220 of the second sub-driver 122. In such an embodiment, each of the sub-drivers 121, 122, and 123 may include a master gamma block for one color, such that configuration cost may be reduced.

The third decoder 123*dc* may provide some of the first gamma voltages provided by the seventh slave gamma block 1231 as the first data voltages, may provide some of the second gamma voltages provided by the eighth slave gamma block 1232 as the second data voltages, and may provide some of the third gamma voltages provided by the ninth slave gamma block 1233 as the third data voltages.

The third output buffer 123*bf* may provide an output of the third decoder 123*dc* to the pixel unit 15. In one embodiment, for example, the third output buffer 123*bf* may be connected to data lines DL(q+1), DL(q+2), DL(q+3), . . . , and DLn. The data lines DL(q+1), DL(q+2), DL(q+3), . . . , and DLn may be connected to another part of the first pixels, another part of the second pixels, and another part of the third pixels.

The data lines DL1, DL2, DL3, . . . , and DLp connected to the first output buffer 121*bf*, the data lines DL(p+1), DL(p+2), DL(p+3), . . . , and DLq connected to the second output buffer 122*bf*, and the data lines DL(q+1), DL(q+2), DL(q+3), . . . , and DLn connected to the third output buffer 123*bf* may be different from each other. Here, p may be an integer greater than 0, and q may be an integer greater than p and less than n. Pixels connected to the first output buffer 121*bf*, pixels connected to the second output buffer 122*bf*, and pixels connected to the third output buffer 123*bf* may be different from each other. According to an embodiment, each of the sub-drivers 121, 122, and 123 may supply the data voltages to different areas (pixels) of the pixel unit 15. Therefore, even in a case where the pixel unit 15 has a large display area, RC delay of the data voltages may be reduced.

In an embodiment, as shown in FIG. 4, the data driver 12 may include a plurality of sub-drivers 121, 122, and 123. In such an embodiment, the plurality of sub-drivers 121, 122, and 123 may be defined by different integrated circuit ("IC") chips, respectively. IN such an embodiment, the data driver 12 may include four or more sub-drivers. In an alternative embodiment, the data driver 12 may be configured as a single driver, that is, a single IC.

Figure 5A:
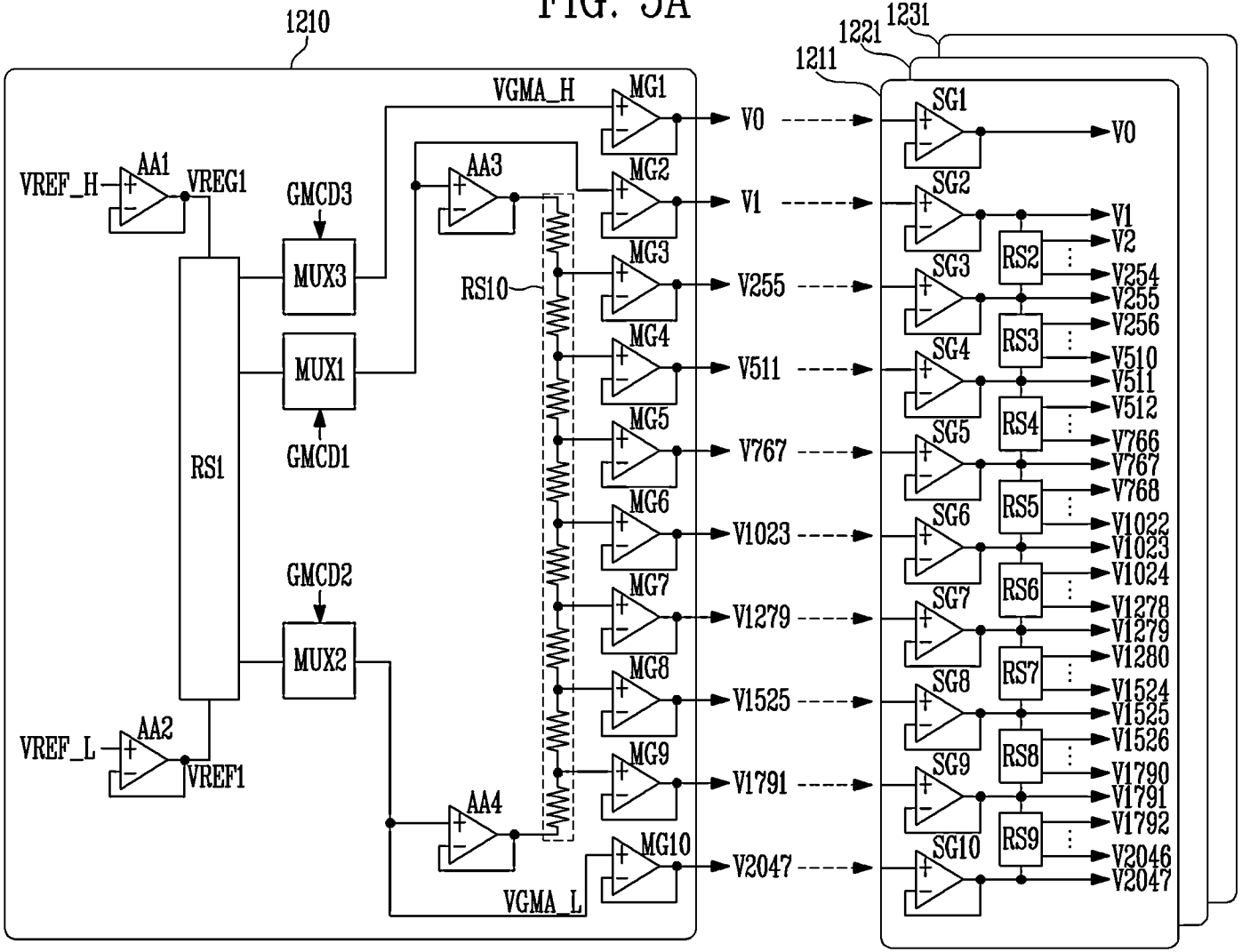
FIG. 5A is a diagram showing a master gamma block and a slave gamma block according to an embodiment of the invention.
Figure 5B:
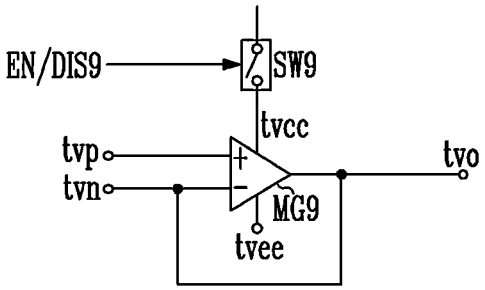
FIG. 5B is an enlarged view of the encircled portion of FIG. 5A.

FIG. 5A is a diagram showing a master gamma block and a slave gamma block according to an embodiment of the invention, and FIG. 5B is an enlarged view of the encircled portion of FIG. 5A.

In FIG. 5A, only the first master gamma block 1210 and the first slave gamma block 1211 of an embodiment of the first sub-driver 121 are shown for convenience of illustration and description. Since the configurations of the fourth slave gamma block 1221 and the seventh slave gamma block 1231 may be substantially the same as the configuration of the first slave gamma block 1211, any repetitive detailed descriptions thereof will be omitted.

In an embodiment, the first master gamma block 1210 may include first master amplifiers MG1, MG2, MG3, MG4, MG5, MG6, MG7, MG8, MG9, and MG10 that generate first reference gamma voltages V0, V1, V255, V511, V767, V1023, V1279, V1525, V1791, and V2047, respectively. In such an embodiment, the first master gamma block 1210 may include auxiliary amplifiers AA1, AA2, AA3, and AA4, multiplexers MUX1, MUX2, and MUX3, and first and tenth resistor strings RS1 and RS10.

An auxiliary amplifier AA1 may receive a high voltage VREF_H and output a first reference voltage VREG1. In such amplifiers, as shown in FIG. 5A, an inverting terminal may be connected to an output terminal (negative feedback), a non-inverting terminal may receive an input voltage, and an output terminal may output an output voltage. Hereinafter, any repetitive detailed description of connections of terminals will be omitted. An auxiliary amplifier AA2 may receive a low voltage VREF_L and output a second reference voltage VREF_1.

One end of the first resistor string RS1 may receive the first reference voltage VREG1, and the other end of the first resistor string RS1 may receive the second reference voltage VREF1. The resistor string RS1 may include a plurality of resistors connected to each other in series.

A first multiplexer MUX1 may provide an input voltage of at least one selected from the first master amplifiers MG1 to MG10 based on a first gamma code GMCD1 received thereby or applied thereto. In one embodiment, for example, the first multiplexer MUX1 may receive a voltage of a specific node among the first resistor string RS1 based on the first gamma code GMCD1 and provide the received voltage to a second first master amplifier MG2.

A second multiplexer MUX2 may provide an input voltage of at least another one selected from the first master amplifiers MG1 to MG10 based on a second gamma code GMCD2 received thereby or applied thereto. In one embodiment, for example, the second multiplexer MUX2 may receive a voltage of a specific node among the resistor string RS1 based on the second gamma code GMCD2 and provide the received voltage to a tenth first master amplifier MG10.

A third multiplexer MUX3 may provide an input voltage of at least another one selected from the first master amplifiers MG1 to MG10 based on a third gamma code GMCD3 received. In one embodiment, for example, the third multiplexer MUX3 may receive a voltage of a specific node among the first resistor string RS1 based on the third gamma code GMCD3 and provide the received voltage to a first first master amplifier MG1.

In an embodiment, a voltage VGMA_H provided by the third multiplexer MUX3 may be greater than a voltage provided by the first multiplexer MUX1. In such an embodiment, the voltage provided by the first multiplexer MUX1 may be greater than a voltage VGMA_L provided by the second multiplexer MUX2. In such an embodiment, the third gamma code GMCD3 may be greater than the first gamma code GMCD1, and the first gamma code GMCD1 may be greater than the second gamma code GMCD2.

The timing controller 11 may provide the second gamma code GMCD2 differently based on the received maximum luminance DBV (refer to FIG. 1). In this case, the first and third gamma codes GMCD1 and GMCD3 may be maintained constant regardless of the received maximum luminance DBV. In one embodiment, for example, when a second maximum luminance is greater than a first maximum luminance, the first gamma code GMCD1 at the first maximum luminance and the first gamma code GMCD1 at the second maximum luminance may be the same as each other. In this case, the second gamma code GMCD2 at the first maximum luminance and the second gamma code GMCD2 at the second maximum luminance may be different from each other. An input voltage VGMA_L provided by the second multiplexer MUX2 at the first maximum luminance may be greater than the input voltage VGMA_L provided by the second multiplexer MUX2 at the second maximum luminance. Therefore, as the maximum luminance DBV is set larger, a difference between a minimum voltage V2047 and a maximum voltage V0 of gamma voltages V0 to V2047 may increase. Also, as the maximum luminance DBV is set smaller, the difference between the minimum voltage V2047 and the maximum voltage V0 of the gamma voltages V0 to V2047 may decrease.

The first master amplifier MG1 may receive an input voltage VGMA_H and output a first reference gamma voltage V0. When the gain is 1, the first first master amplifier MG1 may operate as a unit buffer. Hereinafter, a description related to this will be omitted.

The second first master amplifier MG2 may receive an input voltage from the first multiplexer MUX1 and output a first reference gamma voltage V1.

One end of the tenth resistor string RS10 may be connected to an output terminal of an auxiliary amplifier AA3, and the other end of the tenth resistor string RS10 may be connected to an output terminal of an auxiliary amplifier AA4. The tenth resistor string RS10 may include a plurality of resistors connected to each other in series.

Each of third to ninth first master amplifiers MG3, MG4, MG5, MG6, MG7, MG8, and MG9 may receive an input voltage from one node of the tenth resistor string RS10, and output first reference gamma voltages V255, V511, V767, V1023, V1279, V1525, and V1791 corresponding thereto.

The first master amplifier MG10 may receive the input voltage VGMA_L from the second multiplexer MUX2 and output a corresponding first reference gamma voltage V2047.

The first slave gamma block 1211 may include first slave amplifiers SG1, SG2, SG3, SG4, SG5, SG6, SG7, SG8, SG9, and SG10, each having an input terminal connected to an output terminal of a corresponding one of the first master amplifiers MG1 to MG10 of the first master gamma block 1210. Output voltages V0, V1, V255, V511, V767, V1023, V1279, V1525, V1791, and V2047 of the first slave amplifiers SG1 to SG10 may be the same as output voltages V0, V1, V255, V511, V767, V1023, V1279, V1525, V1791, and V2047 of the corresponding first master amplifiers MG1 to MG10.

The first slave gamma block 1211 may further include second to ninth resistor strings RS2, RS3, RS4, RS5, RS6, RS7, RS8, and RS9 connected to output terminals of adjacent first slave amplifiers SG1 to SG10. In one embodiment, for example, a second resistor string RS2 may connect an output terminal of a second first slave amplifier SG2 and an output terminal of a third first slave amplifier SG3.

The first slave gamma block 1211 may provide the first gamma voltages at intermediate nodes of the second to ninth resistor strings RS2 to RS9. In one embodiment, for example, the second resistor string RS2 may divide the first reference gamma voltage V1 and a first reference gamma voltage V255 to provide first gamma voltages V2 to V254. The third resistor string RS3 may divide the first reference gamma voltage V255 and a first reference gamma voltage V511 to provide first gamma voltages V256 to V510. The fourth resistor string RS4 may divide the first reference gamma voltage V511 and a first reference gamma voltage V767 to provide first gamma voltages V512 to V766. The fifth resistor string RS5 may divide the first reference gamma voltage V767 and a first reference gamma voltage V1023 to provide first gamma voltages V768 to V1022. The sixth resistor string RS6 may divide the first reference gamma voltage V1023 and a first reference gamma voltage V1279 to provide first gamma voltages V1024 to V1278. The seventh resistor string RS7 may divide the first reference gamma voltage V1279 and a first reference gamma voltage V1525 to provide first gamma voltages V1280 to V1524. The eighth resistor string RS8 may divide the first reference gamma voltage V1525 and a first reference gamma voltage V1791 to provide first gamma voltages V1526 to V1790. The ninth resistor string RS9 may divide the first reference gamma voltage V1791 and a first reference gamma voltage V2047 to provide first gamma voltages V1792 to V2046.

In FIG. 5B, an enlarged view of an embodiment of a first master amplifier MG9 is shown. In one embodiment, for example, the ninth first master amplifier MG9 may include a non-inverting input terminal tvp, an inverting input terminal tvn, an output terminal tvo, a first power input terminal tvcc, and a second power input terminal tvee. A range of an output voltage that can be output to the output terminal tvo may be greater than a second voltage applied to the second power input terminal tvee and smaller than a first voltage applied to the first power input terminal tvcc.

In an embodiment, a switch SW9 may be connected to the first power input terminal tvcc of the ninth first master amplifier MG9. The first master amplifier MG9 may be disabled when the switch SW9 is turned off and may be enabled when the switch SW9 is turned on. In an alternative embodiment, the switch SW9 may be connected to the second power input terminal tvee of the ninth first master amplifier MG9.

The switch SW9 may be turned on or turned off based on sub-information EN/DIS9 included in the enable/disable information EN/DIS (refer to FIG. 1). According to an embodiment, other first master amplifiers MG1 to MG8 and MG10 may also be connected to switches similarly to the first master amplifier MG9, and may be enabled or disabled based on the enable/disable information EN/DIS.

In an embodiment, the first slave amplifiers SG1 to SG10 may also be connected to switches similarly to the first master amplifier MG9, and may be enabled or disabled based on the enable/disable information EN/DIS.

In an embodiment, as described above, the timing controller 11 may provide the enable/disable information EN/DIS corresponding to the level of the received maximum luminance DBV to the data driver 12 with reference to the look-up tables of the memory 11MEM (refer to FIG. 1). The first master amplifiers MG1 to MG10 and the first slave amplifiers SG1 to SG10 may be enabled or disabled based on the enable/disable information EN/DIS.

In an embodiment, when the first master amplifiers MG1 to MG10 are enabled or disabled, the connected first slave amplifiers SG1 to SG10 may also be enabled or disabled. In one embodiment, for example, when a first master amplifier MG3 is enabled, the first slave amplifier SG3 may be enabled, and when the first master amplifier MG3 is disabled, the first slave amplifier SG3 may be disabled.

In such an embodiment, the auxiliary amplifiers AA1, AA2, AA3, and AA4 may be optional configurations, and may be excluded from the configuration of the first master gamma block 1210 if undesired. In such an embodiment, the third multiplexer MUX3 may be an optional configuration, and may be excluded from the configuration of the first master gamma block 1210 if undesired. In an embodiment, where the third multiplexer MUX3 is excluded, the first reference gamma voltages may have a range V1 to V2047.

Since the relationship and configuration of the second master gamma block 1220 and the second, fifth, and eighth slave gamma blocks 1212, 1222, and 1232 may be substantially the same as those of FIG. 5A, any repetitive detailed descriptions will be omitted. However, in an embodiment, gamma codes received by the second master gamma block 1220 may be different from gamma codes GMCD1, GMCD2, and GMCD3 received by the first master gamma block 1210.

Since the relationship and configuration of the third master gamma block 1230 and the third, sixth, and ninth slave gamma blocks 1213, 1223, and 1233 may be substantially the same as those of FIG. 5A, any repetitive detailed descriptions will be omitted. However, in an embodiment, gamma codes received by the third master gamma block 1230 may be different from the gamma codes GMCD1, GMCD2, and GMCD3 received by the first master gamma block 1210. In such an embodiment, the gamma codes received by the third master gamma block 1230 may be different from the gamma codes received by the second master gamma block 1220.

The range of gamma voltages corresponding to a color may be changed by changing the gamma codes for the color. Accordingly, a white balance and a balance for the color of interest may be precisely adjusted.

Figure 6:
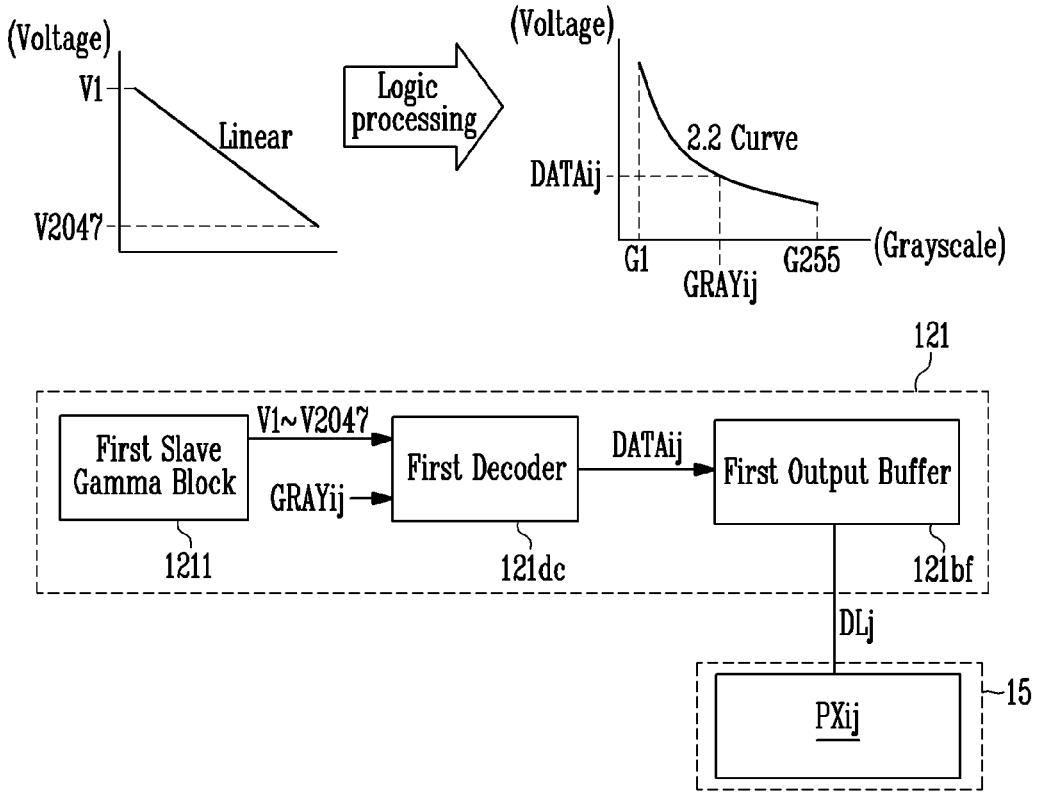
FIG. 6 is a diagram showing a sub-driver of the data driver according to an embodiment of the invention.

FIG. 6 is a diagram showing a sub-driver of the data driver according to an embodiment of the invention.

Referring to FIG. 6, the relationship between the first slave gamma block 1211, the first decoder 121*dc*, and the first output buffer 121*bf* in the first sub-driver 121 will be described. Since the relationship between the other slave gamma blocks, decoders, and output buffers is also substantially the same as those shown in FIG. 6, any repetitive detailed descriptions thereof will be omitted.

In an embodiment, first gamma voltages V1 to V2047 provided by the first slave gamma block 1211 may have a linear voltage at each step. In one embodiment, for example, a slope between a first gamma voltage V1 of a first step and a first gamma voltage V2 of a second step may be the same as a slope between a first gamma voltage V2046 of a 2046th step and a first gamma voltage V2047 of a 2047th step.

The first decoder 121*dc* may provide one of the first gamma voltages V1 to V2047 as a corresponding first data voltage based on the received grayscale. In one embodiment, for example, when receiving a grayscale GRAYij for the pixel PXij, the first decoder 121*dc* may provide a first gamma voltage corresponding to the grayscale GRAYij as a first data voltage DATAij.

In one embodiment, for example, a range (number) of grayscales G1 to G255 may be smaller than a range (number) of the first gamma voltages V1 to V2047. The first decoder 121*dc* may output the first data voltage DATAij corresponding to the grayscale GRAYij to correspond to a set gamma curve (for example, 1.8 gamma, 2.0 gamma, 2.2 gamma, and the like). In such an embodiment, the first data voltages provided by the first decoder 121*dc* may have non-linear voltages in each step GRAY.

The first output buffer 121*bf* may output the received first data voltage DATAij to the pixel PXij through the data line DLj. In an embodiment, the pixel PXij may be a first pixel. Although not shown, the first output buffer 121*bf* may include a plurality of output amplifiers. Similar to the master amplifiers and slave amplifiers described above, the output amplifiers may operate as unit buffers.

FIGS. 7 to 10 are diagrams showing a look-up table according to an embodiment of the invention.

Referring to FIG. 7, the memory 11MEM may store a first look-up table LUT1 corresponding to a level 000 h of the maximum luminance DBV, a second look-up table LUT2 when the level of the maximum luminance DBV belongs to a range (000 h<DBV<DBV1), a third look-up table LUT3 when the level of the maximum luminance DBV belongs to a range (DBV1<DBV<DBV2), a fourth look-up table LUT4 when the level of maximum luminance DBV belongs to a range (DBV2<DBV<DBV3), a fifth look-up table LUT5 when the level of the maximum luminance DBV belongs to a range (DBV3<DBV<DBV4), a sixth look-up table LUTE when the level of the maximum luminance DBV belongs to a range (DBV4<DBV<DBV5), a seventh look-up table LUT7 when the level of the maximum luminance DBV belongs to a range (DBV5<DBV<DBV6), an eighth look-up table LUT8 when the level of the maximum luminance DBV belongs to a range (DBV6<DBV<DBV7), a ninth look-up table LUT9 when the level of the maximum luminance DBV belongs to a range (DBV7<DBV<DBV8), and a tenth look-up table LUT10 when the level of the maximum luminance DBV belongs to a range (DBV8<DBV<FFFh).

In FIG. 8, a configuration of an embodiment of the tenth look-up table LUT10 is shown. Referring to FIG. 7, the tenth look-up table LUT10 may correspond to a case where the level of the maximum luminance DBV is the highest. In this case, all of the first master amplifiers MG1 to MG10 and the first slave amplifiers SG1 to SG10 may be in an enabled state.

In FIG. 9, a configuration of an embodiment of the fifth look-up table LUT5 is shown. Referring to FIG. 7, the level of the corresponding maximum luminance DBV of the fifth look-up table LUT5 may be lower than that of the tenth look-up table LUT10. In this case, among the first master amplifiers MG1 to MG10, v master amplifiers (e.g., MG1, MG3, MG5, MG7, MG9, and MG10) may be enabled and the rest master amplifiers (e.g., MG2, MG4, MG6, and MG8) may be disabled, where v may be 6. In such an embodiment, among the first slave amplifiers SG1 to SG10, v first slave amplifiers (e.g., SG1, SG3, SG5, SG7, SG9, and SG10) may be enabled and the rest first slave amplifiers (e.g., SG2, SG4, SG6, and SG8) may be disabled.

In FIG. 10, a configuration of an embodiment of the second look-up table LUT2 is shown. Referring to FIG. 7, the level of the corresponding maximum luminance DBV of the second look-up table LUT2 may be lower than that of the fifth look-up table LUT5. In this case, among the first master amplifiers MG1 to MG10, u first master amplifiers (e.g., MG1, MG5, MG8, and MG10) may be enabled and the rest first master amplifiers (e.g., MG2, MG3, MG4, MG6, MG7, and MG9) may be disabled, where u may be 4. In such an embodiment, among the first slave amplifiers SG1 to SG10, u first slave amplifiers (e.g., SG1, SG5, SG8, and SG10) may be enabled and the rest first slave amplifiers (e.g., SG2, SG3, SG4, SG6, SG7, and SG9) may be disabled.

According to an embodiment, when the maximum luminance DBV is set to the first maximum luminance (for example, 000 h<DBV<DBV1), among the first master amplifiers MG1 to MG10, u first master amplifiers (for example, 4 first master amplifiers) may be enabled and the rest first master amplifiers may be disabled, where u may be an integer greater than 0. In such an embodiment, when the maximum luminance DBV is set to the second maximum luminance (DBV3<DBV<DBV4) different from the first maximum luminance, among the first master amplifiers MG1 to MG10, v first master amplifiers (for example, 6 first master amplifiers) may be enabled and the rest first master amplifiers may be disabled, where v may be an integer greater than u. In such an embodiment, the second maximum luminance may be greater than the first maximum luminance.

According to an embodiment, when the maximum luminance DBV is set to the first maximum luminance (for example, 000 h<DBV<DBV1), among the first slave amplifiers SG1 to SG10, u first slave amplifiers (for example, 4 first slave amplifiers) may be enabled and the rest first slave amplifiers may be disabled, where u may be an integer greater than 0. In such an embodiment, when the maximum luminance DBV is set to the second maximum luminance (DBV3<DBV<DBV4) different from the first maximum luminance, among the first slave amplifiers SG1 to SG10, v first slave amplifiers (for example, 6 first slave amplifiers) may be enabled and the rest first slave amplifiers may be disabled, where v may be an integer greater than u. In such an embodiment, the second maximum luminance may be greater than the first maximum luminance.

According to an embodiment, when the maximum luminance DBV is set to the first maximum luminance (for example, 000 h<DBV<DBV1), u first master amplifiers among the first master amplifiers MG1 to MG10 and u first slave amplifiers among the first slave amplifiers SG1 to SG10 may be enabled and the rest first master amplifiers and the rest first slave amplifiers may be disabled, where u may be an integer greater than 0. In such an embodiment, when the maximum luminance DBV is set to the second maximum luminance DBV3<DBV<DBV4 different from the first maximum luminance, v first master amplifiers among the first master amplifiers MG1 to MG10 and v first slave amplifiers among the first slave amplifiers SG1 to SG10 may be enabled and the rest first master amplifiers and the first rest slave amplifiers may be disabled, where v may be an integer greater than u. In such an embodiment, the second maximum luminance may be greater than the first maximum luminance.

According to an embodiment, the lower the maximum luminance DBV is set, the more the master amplifiers or the slave amplifiers are disabled, such power consumption may be reduced.

In a case where, all master amplifiers and all slave amplifiers are enabled, when the maximum luminance DBV is relatively high, a voltage difference between adjacent gamma reference voltages may be defined as a first difference. In this case, when the maximum luminance DBV is relatively low, a voltage difference between adjacent gamma reference voltages may be defined as a second difference. The second difference may be less than the first difference. According to an embodiment of the invention, some master amplifiers and some slave amplifiers may be disabled until the second difference reaches the first difference. Accordingly, according to an embodiment of the invention, while charging rates (for example, slew rates) of the gamma voltages are maintained similarly at all maximum luminances DBV, power consumption may be reduced as the maximum luminance DBV is lower. Here, charging of the gamma voltages may refer to, for example, charging of each node of the resistor strings RS2 to RS9 of the first slave gamma block 1211 (refer to FIG. 5A).

Figure 11:
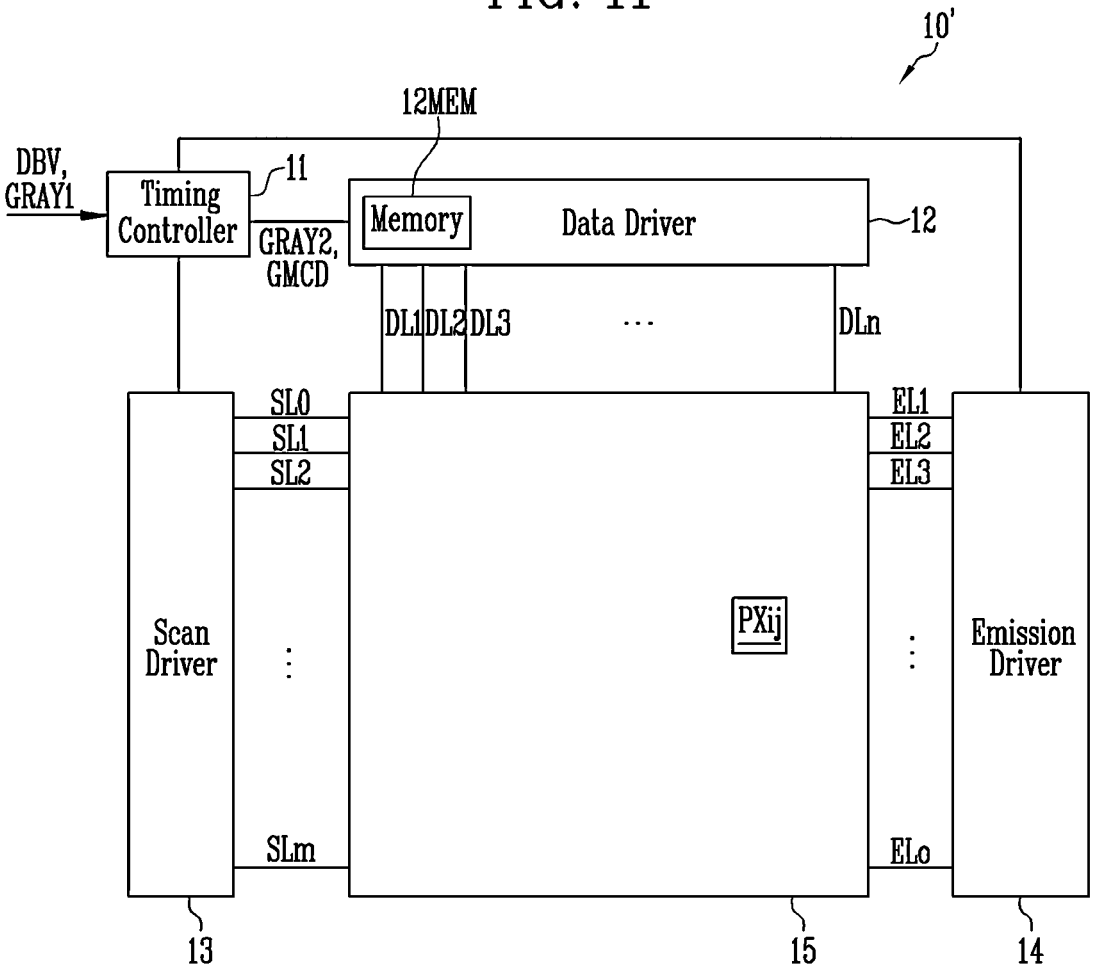
FIG. 11 is a diagram showing a display device according to an alternative embodiment of the invention.

FIG. 11 is a diagram showing a display device according to an alternative embodiment of the invention.

The embodiment of the display device 10' of FIG. 11 may be substantially the same as the embodiment of the display device 10 described above with reference to FIG. 1 except that the data driver 12 includes a memory 12MEM. The same or like elements shown in FIG. 11 have been labeled with the same reference characters as used above to describe the embodiment of the display device shown in FIG. 1, and any repetitive detailed description thereof will hereinafter be omitted or simplified.

In an embodiment, as shown in FIG. 11, the timing controller 11 may not provide the enable/disable information EN/DIS. In such an embodiment, the timing controller 11 may provide the gamma code GMCD corresponding to the level of the received maximum luminance DBV to the data driver 12.

The memory 12MEM may store the look-up tables. Enable or disable states of the master amplifiers and the slave amplifiers corresponding to a level of the gamma code GMCD may be recorded in the look-up tables.

The data driver 12 may include the memory 12MEM, and may enable or disable the master amplifiers and the slave amplifiers with reference to the level of the received gamma code GMCD and a look-up table.

FIG. 12 is a diagram showing a look-up table according to an alternative embodiment of the invention.

In an embodiment, the level of the gamma code GMCD referenced by the look-up tables LUT1 to LUT10 may mean a level of the second gamma code GMCD2.

Referring to FIG. 12, the memory 12MEM may store a first look-up table LUT1 corresponding to a level 000 h of the second gamma code GMCD2, a second look-up table LUT2 when the level of the second gamma code GMCD2 belongs to a range (000 h<GMCD2<GMCD2_1), a third look-up table LUT3 when the level of the second gamma code GMCD2 belongs to a range (GMCD2_1<GMCD2<GMCD2_2), a fourth look-up table LUT4 when the level of the second gamma code GMCD2 belongs to a range (GMCD2_2<GMCD2<GMCD2_3), a fifth look-up table LUT5 when the level of the second gamma code GMCD2 belongs to a range (GMCD2_3<GMCD2<GMCD2_4), a sixth look-up table LUT6 when the level of the second gamma code GMCD2 belongs to a range (GMCD2_4<GMCD2<GMCD2_5), a seventh look-up table LUT7 when the level of second gamma code GMCD2 belongs to a range (GMCD2_5<GMCD2<GMCD2_6), an eighth look-up table LUT8 when the level of the second gamma code GMCD2 belongs to a range (GMCD2_6<GMCD2<GMCD2_7), a ninth look-up table LUT9 when the level of the second gamma code GMCD2 belongs to a range (GMCD2_7<GMCD2<GMCD2_8), and a tenth look-up table LUT10 when the level of the second gamma code GMCD2 belongs to a range (GMCD2_8<GMCD2<GMCD2_9).

Since internal configurations of the look-up tables LUT1 to LUT10 of the memory 12MEM may be the same as internal configurations (refer to FIGS. 8, 9, and 10) of the look-up tables LUT1 to LUT10 of the memory 11MEM described above, any repetitive detailed descriptions thereof will be omitted.

In embodiments of the invention, as described herein, the display device may have reduced power consumption when generating gamma voltages.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display device comprising:

a pixel unit including first pixels which display a first color; and a data driver which supplies first data voltages to the first pixels, wherein the data driver includes:

a first master gamma block including first master amplifiers which generate and output first reference gamma voltages, respectively;

a first slave gamma block which generates first gamma voltages by dividing the first reference gamma voltages; and a first decoder which provides some of the first gamma voltages as the first data voltages, and wherein each of the first master amplifiers is enabled or disabled based on a maximum luminance of the pixel unit, and wherein the first slave gamma block includes first slave amplifiers connected to the first master amplifiers, respectively.

2. The display device of claim 1, wherein when the maximum luminance is set to a first maximum luminance, u first master amplifiers among the first master amplifiers are enabled and the rest first master amplifiers are disabled, wherein u is an integer greater than 0, and when the maximum luminance is set to a second maximum luminance different from the first maximum luminance, v first master amplifiers among the first master amplifiers are enabled and the rest first master amplifiers are disabled, wherein v is an integer greater than u.

3. The display device of claim 2, wherein the second maximum luminance is greater than the first maximum luminance.

4. The display device of claim 3, wherein the first master gamma block further includes a first multiplexer which provides an input voltage of at least one selected from the first master amplifiers based on a first gamma code applied thereto.

5. The display device of claim 4, wherein the first master gamma block further includes a second multiplexer which provides an input voltage of at least another one selected from the first master amplifiers based on a second gamma code applied thereto.

6. The display device of claim 5, wherein the first gamma code at the first maximum luminance and the first gamma code at the second maximum luminance are the same as each other, and the second gamma code at the first maximum luminance and the second gamma code at the second maximum luminance are different from each other.

7. The display device of claim 6, wherein the input voltage provided by the second multiplexer at the first maximum luminance is greater than the input voltage provided by the second multiplexer at the second maximum luminance.

8. The display device of claim 1, further comprising:

a memory which stores look-up tables, wherein enable or disable states of the first master amplifiers corresponding to a level of the maximum luminance are recorded in the look-up tables.

9. The display device of claim 1, wherein wherein when one of the first master amplifiers is enabled or disabled, a corresponding one of the first slave amplifiers connected thereto is enabled or disabled together.

10. The display device of claim 9, further comprising:

a memory which stores look-up tables, wherein enable or disable states of the first master amplifiers and the first slave amplifiers corresponding to a level of the maximum luminance are recorded in the look-up tables.

11. The display device of claim 10, further comprising:

a timing controller including the memory, wherein the timing controller provides enable/disable information corresponding to the level of the maximum luminance received with reference to the look-up tables to the data driver, wherein the first master amplifiers and the first slave amplifiers are enabled or disabled based on the enable/disable information.

12. The display device of claim 9, further comprising:

a memory which stores look-up tables, wherein enable or disable states of the first master amplifiers and the first slave amplifiers corresponding to a level of a gamma code are recorded in the look-up tables.

13. The display device of claim 12, further comprising:

a timing controller which provides the gamma code corresponding to a level of the maximum luminance received thereby to the data driver, the data driver includes the memory, and the first master amplifiers and the first slave amplifiers are enabled or disabled with reference to the level of the gamma code and the look-up tables.

14. The display device of claim 1, wherein the pixel unit further includes:

second pixels which display a second color different from the first color; and third pixels which display a third color different from the first color and the second color, wherein the data driver supplies second data voltages to the second pixels and supplies third data voltages to the third pixels, wherein the data driver includes a first sub-driver, a second sub-driver, and a third sub-driver, wherein the first sub-driver includes the first master gamma block, the first slave gamma block, a second slave gamma block, a third slave gamma block, and the first decoder, wherein the second slave gamma block divides second reference gamma voltages to generate second gamma voltages, wherein the third slave gamma block divides third reference gamma voltages to generate third gamma voltages, and wherein the first decoder provides some of the second gamma voltages as the second data voltages, and provides some of the third gamma voltages as the third data voltages.

15. The display device of claim 14, wherein the second sub-driver includes a second master gamma block, a fourth slave gamma block, a fifth slave gamma block, a sixth slave gamma block, and a second decoder, wherein the second master gamma block generates the second reference gamma voltages, wherein the fourth slave gamma block divides the first reference gamma voltages to generate the first gamma voltages, wherein the fifth slave gamma block divides the second reference gamma voltages to generate the second gamma voltages, wherein the sixth slave gamma block divides the third reference gamma voltages to generate the third gamma voltages, and wherein the second decoder provides some of the first gamma voltages as the first data voltages, provides some of the second gamma voltages as the second data voltages, and provides some of the third gamma voltages as the third data voltages.

16. The display device of claim 15, wherein the third sub-driver includes a third master gamma block, a seventh slave gamma block, an eighth slave gamma block, a ninth slave gamma block, and a third decoder, wherein the third master gamma block generates the third reference gamma voltages, wherein the seventh slave gamma block divides the first reference gamma voltages to generate the first gamma voltages, wherein the eighth slave gamma block divides the second reference gamma voltages to generate the second gamma voltages, wherein the ninth slave gamma block divides the third reference gamma voltages to generate the third gamma voltages, and wherein the third decoder provides some of the first gamma voltages as the first data voltages, provides some of the second gamma voltages as the second data voltages, and provides some of the third gamma voltages as the third data voltages.

17. The display device of claim 16, wherein the first sub-driver further includes a first output buffer which provides an output of the first decoder to the pixel unit, the second sub-driver further includes a second output buffer which provides an output of the second decoder to the pixel unit, and the third sub-driver further includes a third output buffer which provides an output of the third decoder to the pixel unit.

18. The display device of claim 17, wherein data lines connected to the first output buffer, data lines connected to the second output buffer, and data lines connected to the third output buffer are different from each other.

19. The display device of claim 17, wherein pixels connected to the first output buffer, pixels connected to the second output buffer, and pixels connected to the third output buffer are different from each other.

20. The display device of claim 1, wherein a first power input terminal of each of the first master amplifiers is connected to a switch, and each of the first master amplifiers is disabled when the switch is turned off, and is enabled when the switch is turned on.

* * * * *